United States Patent [19]

Jones

[11] Patent Number: 4,915,260

[45] Date of Patent: Apr. 10, 1990

[54] FLOAT CONTROLLED DISPENSER

[75] Inventor: Gregg R. Jones, Cincinnati, Ohio

[73] Assignee: The Drackett Company, Cincinnati, Ohio

[21] Appl. No.: 396,840

[22] Filed: Aug. 21, 1989

Related U.S. Application Data

[63] Continuation of Ser. No. 156,136, Feb. 16, 1988, abandoned.

[51] Int. Cl.[4] ..... E03D 9/02

[52] U.S. Cl. ..... 222/1; 4/227; 4/228; 222/190

[58] Field of Search ..... 4/222, 227, 228, 231; 221/1, 61, 187, 190

[56] References Cited

U.S. PATENT DOCUMENTS

| | | | |
|---|---|---|---|
| 3,504,384 | 4/1970 | Radley et al. | 4/228 |
| 3,698,021 | 10/1972 | Mack et al. | 4/227 |
| 4,200,606 | 4/1980 | Kitko | 4/227 X |
| 4,346,483 | 8/1982 | Rosen et al. | 4/227 |
| 4,370,763 | 2/1983 | Dolan | 4/227 X |
| 4,429,809 | 2/1984 | Bousgorbiés | 4/227 X |
| 4,534,071 | 8/1985 | Russomanno | 4/227 X |
| 4,597,941 | 7/1986 | Bottom et al. | 4/228 X |
| 4,660,231 | 4/1987 | McElfresh et al. | 4/227 X |

*Primary Examiner*—Chris K. Moore
*Attorney, Agent, or Firm*—Gene Warzecha

[57] ABSTRACT

The invention relates to a float controlled dispenser capable of segregating active ingredients and dye and selectively releasing a predetermined amount of each into the tank of a toilet. The dispenser comprises a float operated dispenser having the fluid disinfectant in the main body of the dispenser and the dye in a separate portion of the dispenser. A mixing chamber communicating with the tank water is provided beneath the float so that, on the upstroke, water rising in the chamber serves to dissolve the dye and raise the float. A solution of dye and water is retained in the mixing chamber. During the flush cycle, as the float is lowered on the downstroke due to a decreasing water level in the tank, a measured amount of disinfectant is released from the body of the dispenser into a metering chamber on the float. As the float rises with the water level and seals the dispenser orifice, this measured amount is transferred to the surrounding tank. The dye mixture retained in the chamber is dispensed on the downstroke, at which time the decreasing water level in the toilet tank draws the mixture from the chamber into the tank.

5 Claims, 7 Drawing Sheets

FLOAT CONTROLLED DISPENSER

This is a continuing application of Application Ser. No. 156,136 filed Feb. 16, 1988, and now abandoned.

BACKGROUND OF THE INVENTION

1. Field of the Invention

The invention relates generally to containers for automatically dispensing a selected product into a toilet bowl tank. More particularly, the invention relates to a float controlled dispenser for dispensing metered amounts of a liquid into the toilet tank and separately dispensing a quantity of water colorant.

2. Description of the Prior Art

Automatic dispensing devices for dispensing disinfectant or cleanser into toilet bowl tanks are well-known. A representative type of dispenser for releasing a measured amount of fluid into a toilet tank is, for example, shown in U.S. Pat. No. 3,698,021 (Mack et al.) assigned to the assignee hereof. While all known automatic toilet tank liquid dispensers are able to dispense predetermined liquid mixtures with varying degrees of efficiency, all of the known dispensers are used relatively stable solutions which are then dispensed in measured amounts over extended periods of time. The contents of these dispensers, for example, may comprise a variety of active ingredients such as, for example, a detergent cleanser or a disinfectant liquid, but in all cases the dispenser contents must be retained in the dispenser for relatively long intervals between metered uses. This necessarily means that the contents must be stable for long periods. This stability is also necessary during warehouse storage of the dispenser, prior to purchase by consumers. Warehouse temperatures may be expected to reach 100° F. to 125° F. and, since chemical reactions within dispensers tend to increase as a function of ambient temperature, it is important to segregate unstable substances prior to use. Therefore, any active ingredients within prior art dispensers cannot be mixed with other ingredients if a solution having some unacceptable instability would be produced thereby.

One disadvantage of the prior art dispensers is that they are incapable of dispensing a colored active ingredient such as a disinfectant solution comprising a dye incompatible with the disinfectant. While surfactant-based dispenser contents remain stable when dyed to a variety of colors, bleach-based contents are unstable over long periods. For example, a disinfectant such as hypochlorite would be expected to oxidize any dye so that the resultant solution would relatively quickly become colorless and neutral. Since the advantages of using dye to produce a visual indication of the dispenser contents are well known, it would be desirable to produce a colored disinfectant solution so that there would be some visual indication that the dispenser has ceased being effective. In order to produce such a solution which is colored for a time sufficiently long to be of practical use, the active ingredient and dye must be kept separated as long as possible prior to being dispensed in metered amounts.

It is, therefore, an object of the present invention to provide a toilet tank dispenser capable of dispensing a measured amount of disinfectant and dye into the tank.

It is a further object of this invention to provide a toilet tank dispenser for dispensing measured amounts of an active ingredient and separately dispensing a dye into the tank.

SUMMARY OF THE INVENTION

These and other objects of the invention are achieved by a preferred embodiment which provides an improvement to a conventional float controlled dispenser, the improvement comprising a cap means connected to the neck of the bottle portion of the dispenser, the cap comprising a hollow cylindrical body surrounding said shroud and float member, said body being open at one end for mateable engagement with a portion of said neck adjacent said orifice, said body being provided with an axial aperture at the other, closed end and with at least one first aperture in the cylindrical surface thereof; an axially aligned hollow cylindrical projection within said cylindrical body, said projection connected at one end thereof to said other end of said hollow cylindrical body around said axial aperture and having a predetermined length, said projection provided with at least one second aperture in the cylindrical surface thereof; and a water soluble dye situated adjacent the closed end of said cylindrical body between the interior surface thereof and the surface of said cylindrical projection and below said second aperture.

DESCRIPTION OF THE PREFERRED EMBODIMENT

Figure 1:
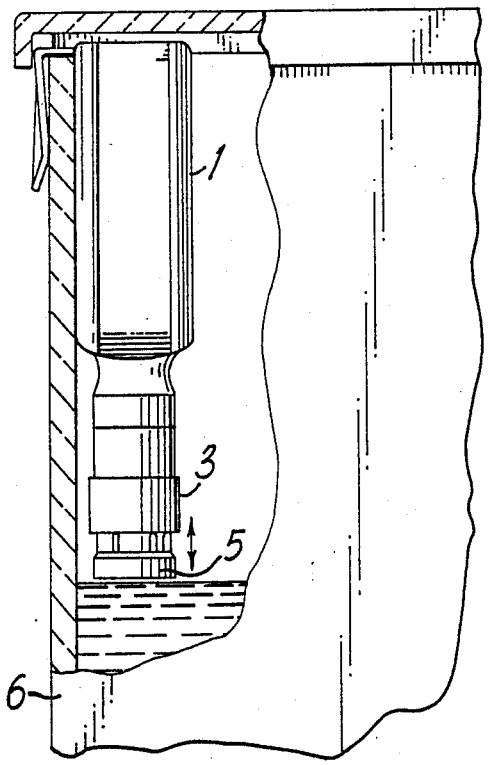
FIG. 1 shows a schematic side elevation view of a prior art dispenser in its normal inverted position within a toilet tank.

FIG. 1 shows a prior art dispenser 1 from the aforementioned U.S. Pat. No. 3,698,021. Dispenser 1 is an upstroke dispenser and includes a shroud 3 fixedly secured to the orifice of the dispenser and a float 5 movable within the shroud in response to the water level in tank 6. The term "upstroke" refers to a dispenser which releases its active ingredient in the toilet tank during that portion of the flush cycle where the water level in the toilet tank is rising. The term "downstroke" refers to a dispener which releases its contents as the water level is falling.

Figure 2:
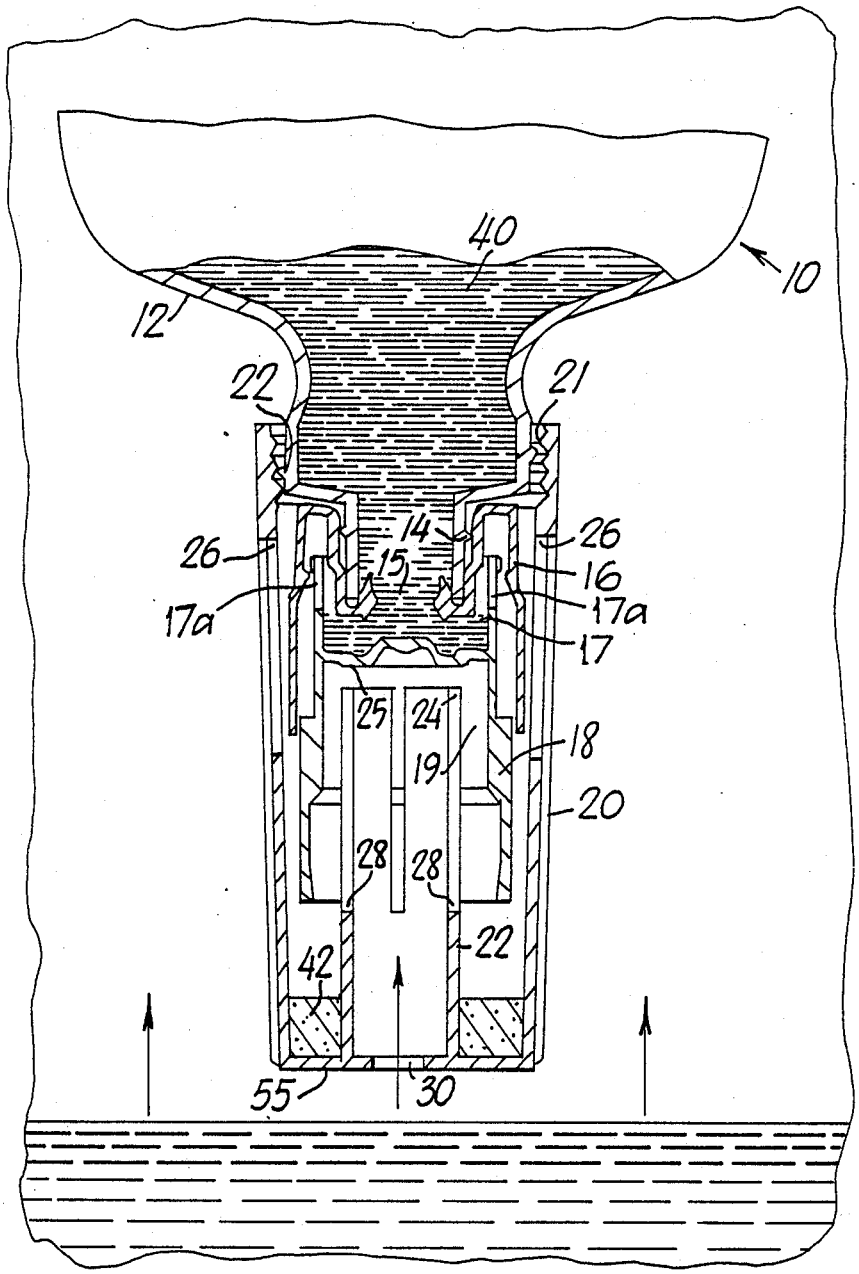
FIG. 2 shows a cross-sectional view of a portion of a dispenser constructed in accordance with the principles of the invention. This view shows the invention in its inverted, normally operating configuration and shows the relationship between the various parts of the dispenser and the water level in the toilet tank during the upstroke portion of the flush cycle.

As shown in FIG. 2, dispenser 10 (only a portion of which is shown) comprises a main container body portion 12 having an open neck 14, a shroud 16 pressed or otherwise secured to neck 14 to form an orifice 15 and a float member 18 slidably mounted on the inside of shroud 16. The components of dispenser 10 thus far described, and their operation, are identical to the comparable components and operation shown and described in the aforementioned U.S. Pat. No. 3,698,021. It is noted that, as with dispenser 1 in FIG. 1, dispenser 10 is shown in its inverted configuration which is the normally operating configuration inside a toilet tank. Float member 18 includes a measuring chamber 17, an air bell 19 and a bottom wall 25 therebetween. A plurality of circumferentially spaced longitudinally extending slits 17*a* are provided adjacent the top rim of measuring chamber 17. As float member 18 alternately rises and falls in response to the water level within the tank, measuring chamber 17 will be alternately filled with the contents of the dispenser which will subsequently be emptied via slits 17*a* as the float member rises and seals orifice 15. The contents of the measuring chamber then pass through the annular gap between shroud 16 and float member 18 into the tank as will be understood below.

Figure 3A:
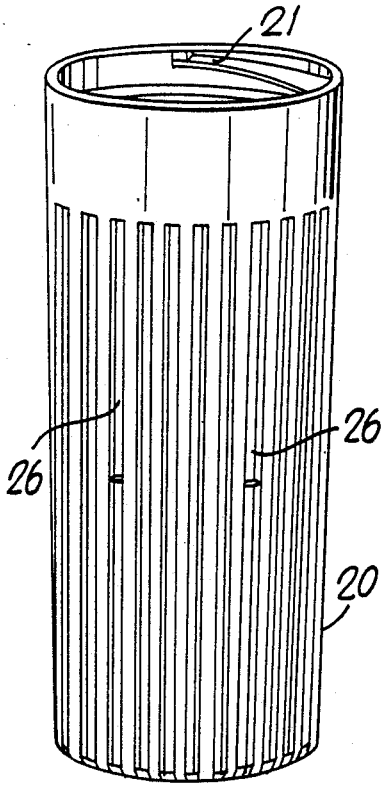
FIGS. 3*a* and 3*b* are perspective elevational and cross-sectional views, respectively, of the overcap shown in FIG. 1.
Figure 3B:
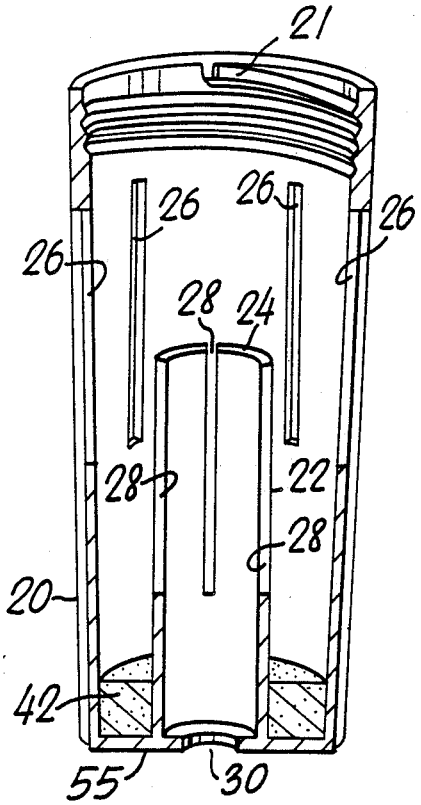

Dispenser 10 includes an overcap 20 having threads 21 for threadably attaching cap 20 to threads 22 on the body of container 12. It is noted that, unlike prior art dispenser 1 the overcap of which was intended to be discarded in order to expose float 5 to permit proper operation of the device, the overcap 20 of the present invention is intended to remain a part of dispenser 10 during normal operation. As best seen in FIGS. 3A and 3B, overcap 20 includes an axial hollow stem 22 having a sufficient length so that when overcap 20 is fully threaded onto container 12, the end portion 24 of stem 22 presses against the bottom 25 of float member 18 to seal the orifice 15 of shroud 16. Overcap 20 is generally cylindrical and has a sufficient inside diameter to enable float member 18 to slide vertically within a predetermined range within the overcap. Overcap 20 is provided with a plurality of axially aligned narrow slits 26 in its surface, the purpose of which will be explained below. Stem 22 is provided with a plurality of axially aligned narrow slits 28, the purpose of which will also be explained below. Slits 26 are, in the preferred embodiment, bounded on four sides while slits 28 are open at the side adjacent stem end portion 24. Overcap 20 has a central aperture 30 within stem 22 through which some of the dispenser contents are ultimately released.

In the preferred embodiment, dispenser 10 is provided with a hypochlorite solution as the active ingredient 40 within container 12 and a water-soluble dye such as triarylmethane (Acid Blue 190 9) in a solid annular tablet form 42 adjacent the bottom end of overcap 20. As will be further explained below, liquid Acid Blue 190 9 has viscosity properties such that, when the tablet is dissolved in water the resulting solution has a range of viscosity (i.e. density) causing the solution to tend to remain in the bottom end of overcap 20 until there is sufficient water flow therethrough to circulate the dye from the overcap into the tank. The viscosity (e.g. density) gradient of the solution above the tablet 42 serves this function minimizing dye migration to the tank by keeping the dye solution primarily in the overcap between cycles. Also, providing dye in (a dissolved) liquid form enables it to quickly be dispersed throughout the tank. The tablet is sufficiently large to last approximately as long as the active ingredient in container 12.

It is noted that FIG. 2 shows the condition of dispenser 10 prior to its first use, that is, prior to any water ever having entered any part of the dispenser. As will be understood, after the first flush cycle there will be some liquid above tablet 42 even if the water level in the tank is below the dispenser.

Figure 4:
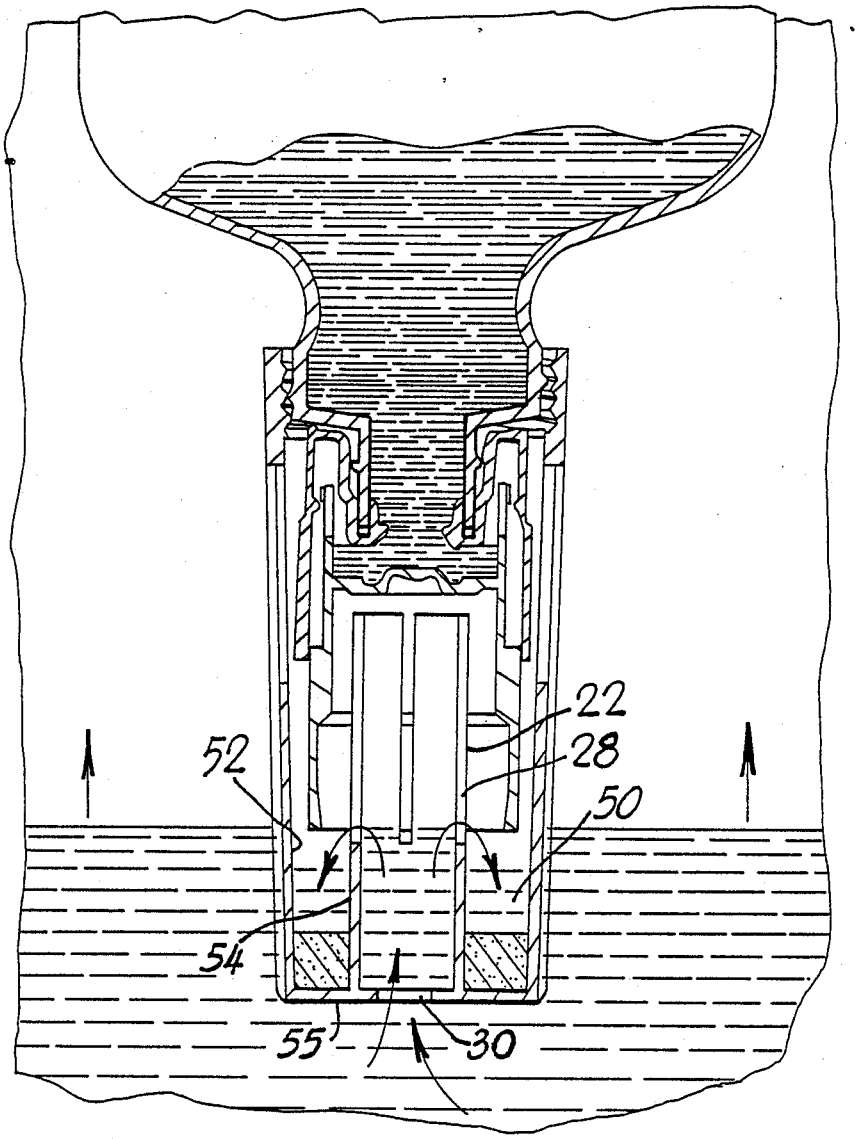
FIGS. 4 and 5 are schematic views of the water flowing into the dispenser shown in FIG. 1 during a portion of the first upstroke of the flush cycle.
Figure 5:
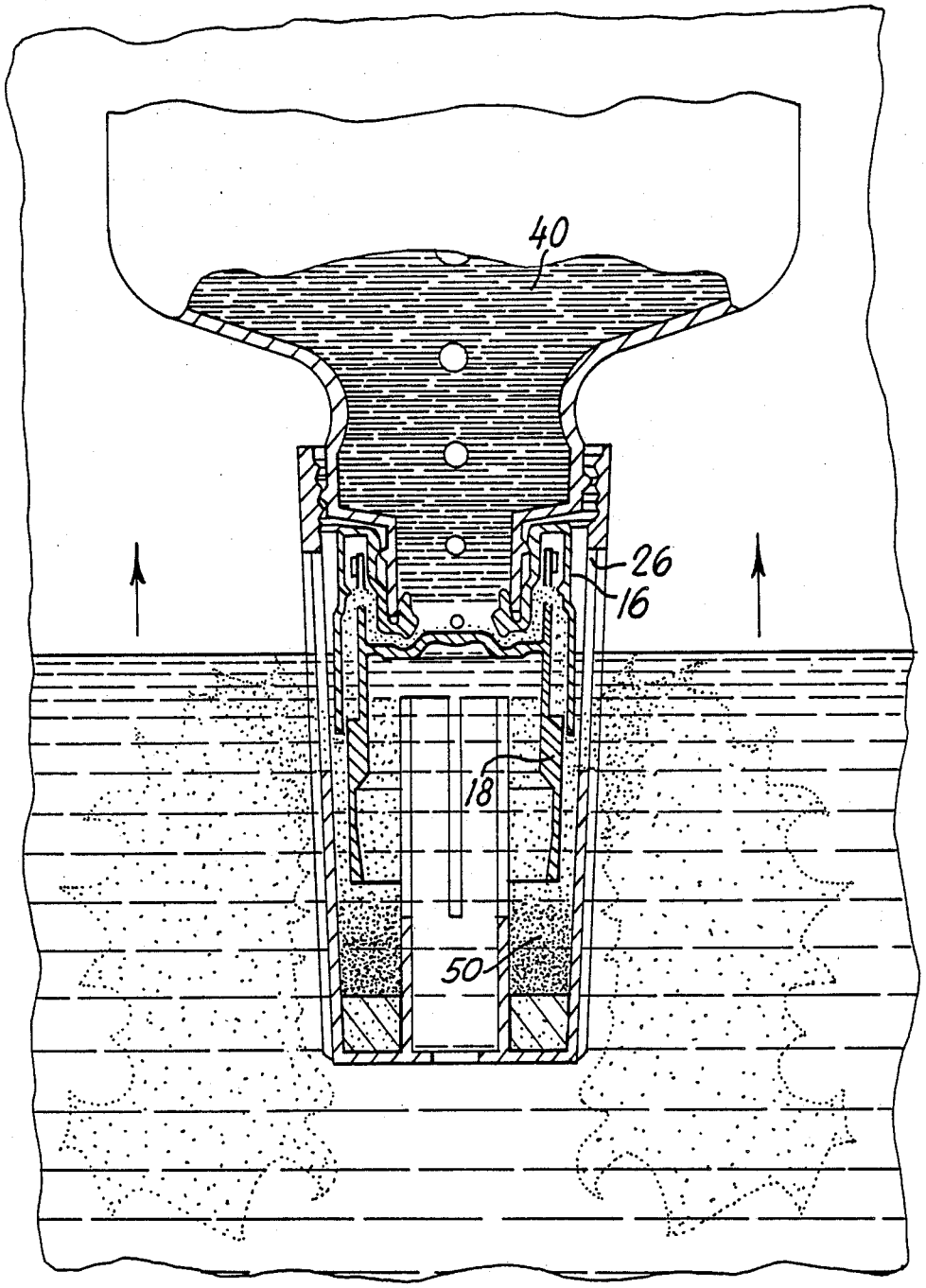

By reference to FIGS. 4 and 5, the operation of the invention during the upstroke or fill portion of the flush cycle will be understood. As the water level in the toilet tank rises about overcap 20 it rises also into the interior of stem 22 through aperture 30 and, as shown in FIG. 4, when the water level rises above the bottom of slits 28 it spills over into the annular intermediate mixing chamber 50 which is formed between the interior surface 52 of the body of overcap 20, the exterior bottom surface 54 of stem 22 and the annular end 55 of cap 20. The water begins to dissolve the dye on contact and, as shown in FIG. 5, as the water level in the tank continues to rise the dye solution is further diluted simply because of the increased volume of water entering chamber 50.

Figure 6:
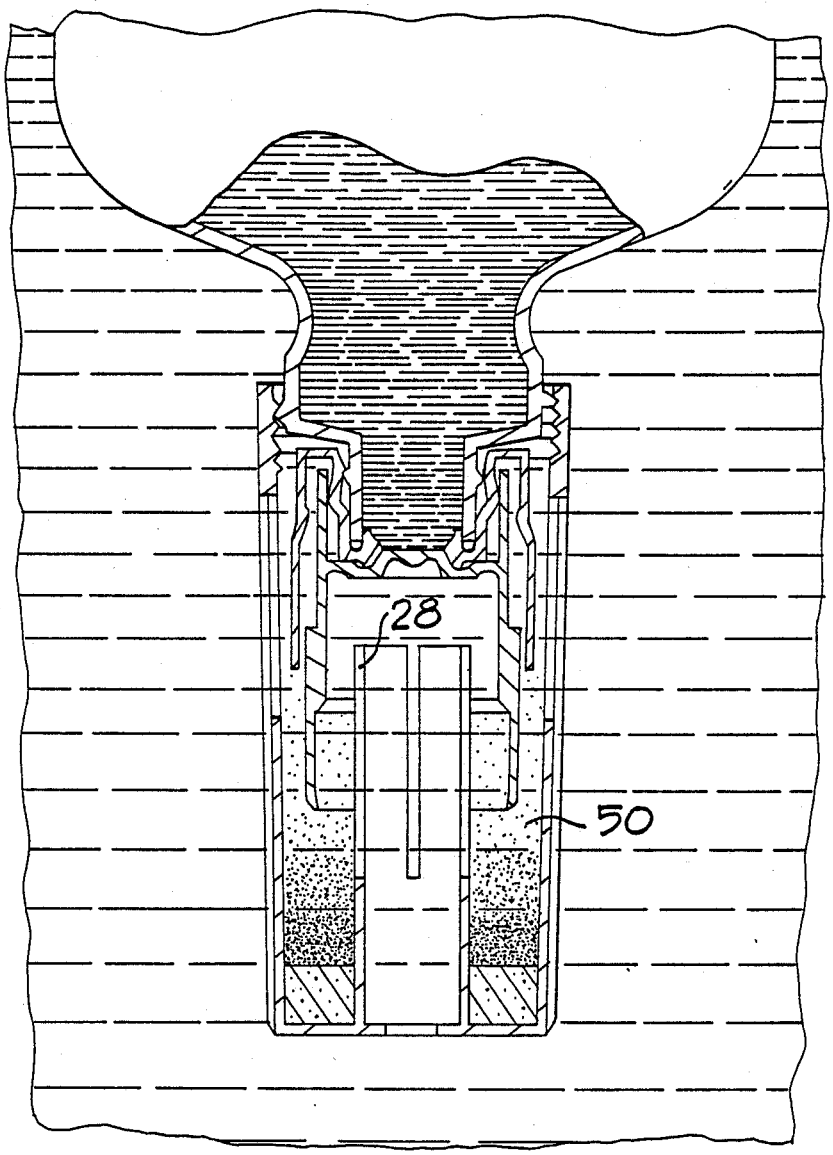
FIG. 6 is a schematic view of the dispenser in equilibrium when the water level in the toilet tank has reached its highest level.

As best seen in FIG. 5, as the water level in the tank continues to rise, float 18 rises with it and begins to expel the metered amount of hypochlorite solution 40 which was being retained in the top of the float member. The operation of the float is to this extent the same as float 5 of dispenser 1. As solution 40 spills over into the annular space between float 18 and shroud 16, it passes under shroud 16 and out slits 26 into the water in the tank. As the water level continues to rise in the tank, an equilibrium condition is eventually reached, as best seen in FIG. 6, whereby float 18 is in its uppermost position closing the orifice of the container. The solution 40 which had been spilling from the top of the float member has been fully dispensed into the water in the tank and the dye solution in chamber 50 is retained therein until the next downstroke. The solution in chamber 50 is a combination of dye and water relatively free of the active ingredient 40 because of the relative densities of the dye and the active. It should be noted that, while FIGS. 5 and 6 do not show any dye within stem 22, the presence of slits 28 necessarily means there is some liquid communication between the interior of stem 22 and chamber 50. Some dye solution may, therefore, be present within the stem. The dye solution in chamber 50 will be dispensed therein in a concentration gradient with the most concentrated solution being at the bottom of chamber 50. The migration of dye from stem 22 to the tank via slits 28 is minimized because of the concentration gradient caused by the viscous nature of the dye. As stated above, the preferred embodiment incorporates a dye which is inherently viscous to produce a dye solution (when dissolved in water) of varying densities depending upon the proximity of the dissolved dye to the tablet or undissolved (solid-form) dye. It will be understood by those of ordinary skill in the art that a wolid form of dye situated at the bottom of a column of non-circulating water (as is the condition of the water in chamber 50 between cycles) will dissolve in such a way as to produce a dye solution having a greater concentration of dye adjacent the solid form, with a gradually decreasing concentration of dye at greater distances from the solid form. The viscosity of the dye used in the preferred embodiment is such as to cause the dye to dissolve in water with the aforementioned density gradient.

Figure 7:
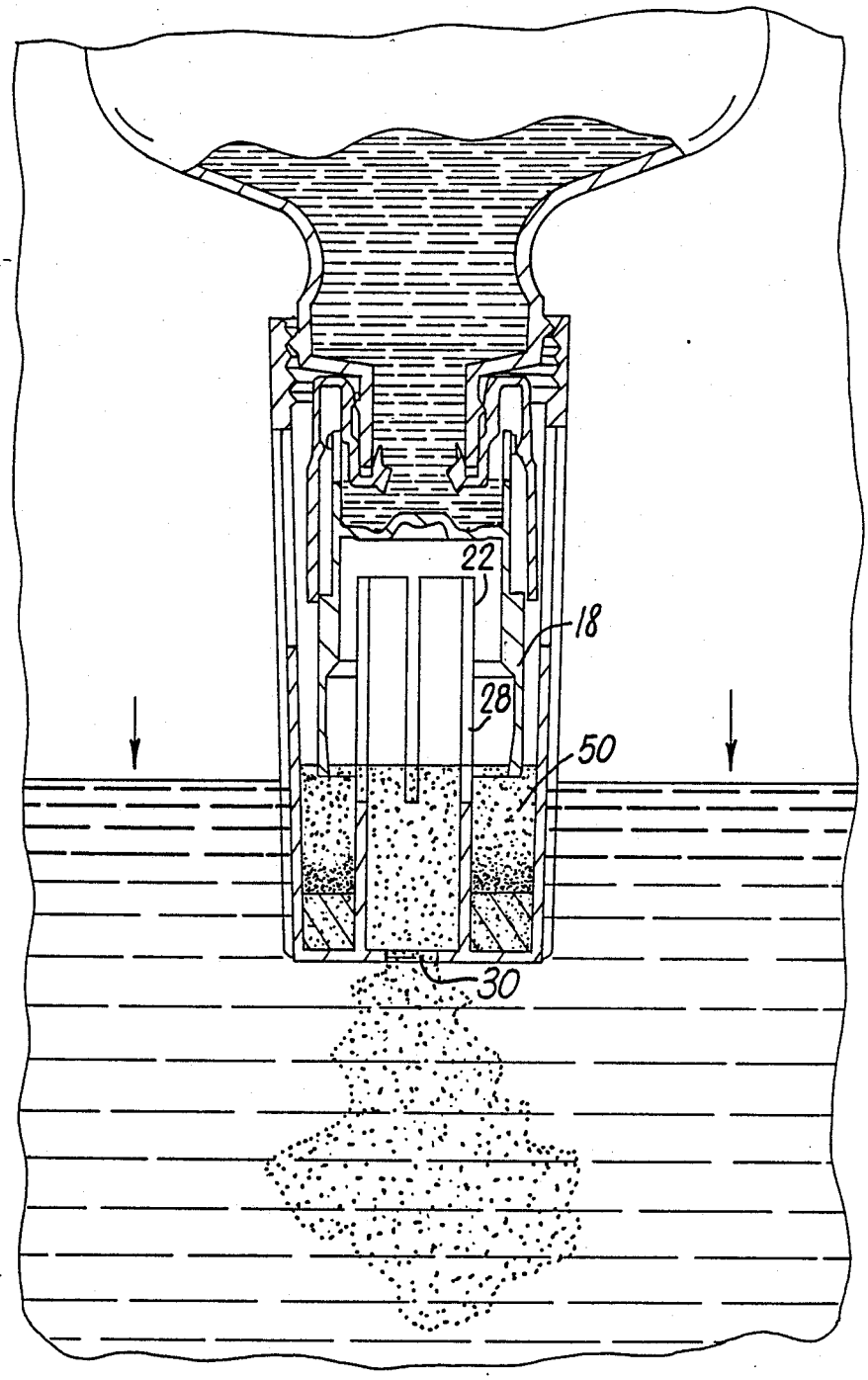
FIG. 7 shows the operation of the dispenser during the downstroke portion of the flush cycle as the water level is receeding.

As shown in FIG. 7, as the water level recedes during the downstroke portion of the flush cycle, the contents of chamber 50 are released into the toilet tank via slits 28 and aperture 30. Because of the downstroke delivery of the dye, the majority of the dye will be segregated from the hypochlorite which was delivered on the upstroke. Thus, the active ingredient can remain in the tank in the equilibrium state in a suitable concentration to retain its effectiveness. On the downstroke, the tank water treated with the active ingredient will initially flush down the toilet and then the dyed tank water will, near the end of the downstroke, remain in the toilet bowl in a relatively high concentration sufficient to maintain its colored state. As stated above, the water level in chamber 50 will not (in all flush cycles subsequent to the first one) be below the bottom of slits 28. The small quantity remaining in this space enables the dispenser to quickly-re-cycle to be ready with dye solution for the next cycle.

It will be understood by those skilled in the art that numerous other modifications and improvements may be made to the preferred embodiment of the invention disclosed herein without departing from the spirit and scope thereof.

What is claimed is:

1. In a dispenser for dispensing a measured amount of fluid into a toilet tank, the dispenser having a container portion and an open neck portion, a shroud mounted concentrically over the neck portion and extending outwardly therefrom having an inner restricting means which engages and restricts the container neck portion to form an orifice; a float member slidably and concentrically mounted on the shroud having upper and lower segments, the upper of which being adjacent to the container neck portion; an air bell constructed in the lower segment of the float member; a measuring chamber constructed in the upper segment of the float member in communication with said orifice, said measuring chamber having a discharge outlet and means for engaging said orifice in a sealed relation at the uppermost position of the float member's sliding motion; and means for mounting the dispensing package on the wall of a fluid tank in an inverted position so that the float member rises and falls with the fluid level in the tank, the improvement comprising a cap means connected to the neck of said bottle portion, said cap means comprising:

a hollow cylindrical body surrounding said shroud and float member, said body being open at one end for mateable engagement with a portion of said neck adjacent said orifice, said body being provided with an axial aperture at the other, closed end and with at least one first aperture in the cylindrical surface of said body;

an axially aligned hollow cylindrical projection within said cylindrical body, said projection connected at one end thereof to said other, closed end of said hollow cylindrical body around said axial aperture and having a predetermined length, said projection provided with at least one second aperture in the cylindrical surface thereof; and a water-soluble dye situated adjacent the closed end of said cylindrical body between the interior surface thereof and the surface of said cylindrical projection and below said second aperture.

2. In a dispenser according to claim 1 the improvement further comprising:

each said first aperture being a longitudinal slit having a first predetermined length; and each said second aperture being a longitudinal slit having a second predetermined length.

3. In a dispenser according to claim 2 the improvement further comprising:

said first and second apertures being circumferentially spaced in the surfaces of said hollow cylindrical body and said hollow cylindrical projection, respectively.

4. In a dispenser according to claim 1 the improvement further comprising:

means for threadably connected said hollow cylindrical body to the neck of said bottle portion and wherein said predetermined length of said axially aligned hollow cylindrical projection is sufficient to urge said float member against said orifice to seal same when the hollow cylindrical body is threadably advanced to a closed position.

5. A method of dispensing an active ingredient and a water-soluble dye into a toilet tank, said active ingredient and dye being substantially unstable whereby said dye will be neutralized in a relatively short time if exposed to a predetermined concentrated amount of said active ingredient, said method comprising the steps of:

retaining said active ingredient and said dye in separate compartments of the same dispenser, said dispenser being a float-controlled dispenser wherein the float moves in response to the water level in the tank between an uppermost, closed position and a bottommost position;

withdrawing a predetermined amount of said active ingredient from said compartment containing same on the downstroke;

retaining said predetermined amount of active ingredient in a metering chamber;

introducing a predetermined amount of water from the tank to said compartment containing said dye on the upstroke to form a viscous dye solution in said compartment, said dye-containing compartment being in liquid communication with the water in said tank thereby enabling migration of a portion of said dye solution from said dye-containing compartment to the water in said tank;

expelling said predetermined amount of active ingredient from said metering chamber into said tank on the upstroke;

releasing the remainder of said viscous dye solution from said dye-containing compartment into said tank on the downstroke.

* * * * *

UNITED STATES PATENT AND TRADEMARK OFFICE

CERTIFICATE OF CORRECTION

PATENT NO. : 4,915,260

DATED : April 10, 1990

INVENTOR(S) : Gregg R. Jones

It is certified that error appears in the above-identified patent and that said Letters Patent is hereby corrected as shown below:

Column 3, line 47, change "190" to read -- # --;

Column 3, line 50, change "190" to read -- # --.

Column 4, line 50, "wolid" should read -- solid --.

Claim 4, line 3, "connected" should read -- connecting --.

Signed and Sealed this

Third Day of July, 1990

*Attest:*

*Attesting Officer*

HARRY F. MANBECK, JR.

*Commissioner of Patents and Trademarks*